United States Patent [19]

Pryor et al.

[11] Patent Number: 4,594,117

[45] Date of Patent: Jun. 10, 1986

[54] COPPER BASE ALLOY FOR FORGING FROM A SEMI-SOLID SLURRY CONDITION

[75] Inventors: Michael J. Pryor, Woodbridge; Joseph Winter, New Haven; Jonathan A. Dantzig, Hamden, all of Conn.

[73] Assignee: Olin Corporation, New Haven, Conn.

[21] Appl. No.: 616,081

[22] Filed: May 31, 1984

Related U.S. Application Data

[62] Division of Ser. No. 337,560, Jan. 6, 1982, Pat. No. 4,494,461.

[51] Int. Cl.[4] ..... C22C 9/06; C22C 9/01; C22F 1/08; C22F 3/00

[52] U.S. Cl. ..... 148/414; 148/435; 148/436; 420/486

[58] Field of Search ..... 102/464, 430; 164/900; 29/1.3, 1.31, 1.32; 148/414, 435, 436, 411; 420/486, 489

[56] References Cited

U.S. PATENT DOCUMENTS

| | | | |
|---|---|---|---|
| 1,303,727 | 5/1919 | Rice | 148/2 |
| 1,755,554 | 4/1930 | Modge | 148/414 |
| 2,031,315 | 2/1936 | Jennison | 75/1 |
| 2,034,562 | 3/1936 | Davis et al. | 420/486 |
| 2,190,536 | 2/1940 | Staiger | 29/1.3 |
| 2,430,419 | 11/1947 | Edens | 219/8 |
| 2,489,529 | 11/1949 | Grange | 148/414 |
| 2,698,268 | 12/1954 | Lyon | 148/12.4 |
| 2,789,900 | 4/1957 | Hannon | 75/159 |
| 2,810,641 | 10/1957 | Roberts | 148/414 |
| 2,851,353 | 9/1958 | Roach et al. | 75/159 |
| 3,209,691 | 10/1965 | Herter | 102/464 |
| 3,364,016 | 1/1968 | Mikawa | 75/159 |
| 3,378,413 | 4/1968 | Ingerson | 148/414 |
| 3,399,057 | 8/1968 | Richardson et al. | 420/486 |
| 3,416,915 | 12/1968 | Mikawa | 75/159 |
| 3,498,221 | 3/1970 | Hilton et al. | 102/43 |
| 3,824,135 | 7/1974 | Pryor et al. | 148/414 |
| 3,877,375 | 4/1975 | Barr | 102/470 |
| 3,902,544 | 9/1975 | Flemings et al. | 164/71 |
| 3,936,298 | 2/1976 | Mehrabian et al. | 75/134 R |
| 3,948,650 | 4/1976 | Flemings et al. | 75/135 |
| 3,951,651 | 4/1976 | Mehrabian et al. | 75/135 |
| 3,954,455 | 5/1976 | Flemings et al. | 75/134 R |
| 4,011,901 | 3/1977 | Flemings et al. | 164/900 |

(List continued on next page.)

FOREIGN PATENT DOCUMENTS

| | | | |
|---|---|---|---|
| 37129 | 4/1978 | Japan | 420/486 |
| 53-41096 | 10/1978 | Japan . | |
| 727021 | 3/1955 | United Kingdom | 420/486 |
| 1569466 | 6/1980 | United Kingdom . | |
| 2042386 | 9/1980 | United Kingdom . | |
| 2042385 | 9/1980 | United Kingdom . | |
| 206097 | 12/1967 | U.S.S.R. | 420/486 |

OTHER PUBLICATIONS

"Precipitation Hardening of Cu-5 wt. % Ni-2.5 wt. % Al Alloys", Tsuda et al., *Chemical Abstracts*, 1980, 93:77670w.

"Aging Characteristics of Copper-30% Nickel-Aluminum Alloys", Miki et al., *Chemical Abstracts*, 1979, 90:190844g.

(List continued on next page.)

*Primary Examiner*—L. Dewayne Rutledge
*Assistant Examiner*—John J. Zimmerman
*Attorney, Agent, or Firm*—Barry L. Kelmachter; Paul Weinstein; Howard M. Cohn

[57] ABSTRACT

A process and apparatus for forming a thin-walled, elongated member having superior strength properties from an age hardenable copper base alloy consisting essentially of about 3% to about 20% nickel, about 5% to about 10% aluminum, and the balance essentially copper, is described herein. A slug or billet of a slurry cast, age hardenable copper base alloy is formed into a semi-solid slurry having about 5% to about 40% of the alloy in a liquid phase. The semi-solid slurry is then thixoforged to form the thin-walled, elongated member. Thereafter, the member is age hardened to provide a product having desired strength properties. The process and apparatus of the instant invention may be utilized to form cartridge casings.

9 Claims, 9 Drawing Figures

U.S. PATENT DOCUMENTS

| | | | |
|---|---|---|---|
| 4,016,010 | 4/1977 | Caron et al. | 148/12.7 C |
| 4,073,667 | 2/1978 | Caron et al. | 148/12.7 C |
| 4,106,956 | 8/1978 | Bercovici | 148/11.5 A |
| 4,338,130 | 7/1982 | Burkett | 420/486 |
| 4,345,637 | 8/1982 | Flemings et al. | 164/900 |
| 4,378,332 | 3/1983 | Chang et al. | 420/486 |
| 4,401,488 | 8/1983 | Prinz et al. | 148/435 |
| 4,415,374 | 11/1983 | Young et al. | 148/11.5 C |
| 4,434,839 | 3/1984 | Vogel | 164/900 |
| 4,450,893 | 5/1984 | Winter et al. | 164/900 |

OTHER PUBLICATIONS

"Copper Alloys", Mid-Jun. 1983-*Metal Progress,* p. 41.

"Rheocasting Processes" by Flemings et al., *AFS International Cast Metals Journal,* Sep. 1976, pp. 11-22.

"Die Casting Partially Solidified High Copper Content Alloys" by Fascetta et al., *AFS Cast Metals Research Journal,* Dec. 1973, pp. 167-171.

"Copper-Rich Nickel-Aluminum-Copper Alloys, Part I-The Effect of Heat-Treatment on Hardness and Electrical Resistivity", by Alexander, W. O. et al., *Journal of the Institute of Metals,* vol. 61, 1937, pp. 83-102.

"Copper-Rich Nickel-Aluminum-Copper Alloys, Part II-The Constitution of the Copper-Nickel-Rich Alloys", by Alexander, W. O., *Journal of the Institute of Metals,* vol. 63, 1938, pp. 163-189.

"Copper-Rich-Nickel-Aluminum-Copper Alloys, Part III-Effect of Heat Treatment on Microstructure", by Alexander, W. O., *Journal of the Institute of Metals,* vol. 64, pp. 217-230.

"Aluminum-Copper-Nickel", by Sinizer, D. I., *Metals Handbook 1948 Edition,* p. 1243.

COPPER BASE ALLOY FOR FORGING FROM A SEMI-SOLID SLURRY CONDITION

This application is a division, of application Ser. No. 337,560, filed 1/6/82 now U.S. Pat. No. 4,494,461.

The instant invention relates to a process and apparatus for forming a thin-walled, elongated member having superior strength properties from an age hardenable copper base alloy. The thin-walled, elongated member of the instant invention has particular utility as a cartridge casing.

In the manufacture of thin-walled, elongated, high strength members for use as cartridge casings, it is highly desirable to form the member from a material having physical properties capable of achieving certain desired objectives, i.e. sufficient fracture toughness to withstand the shock associated with firing, good formability so that the member can expand during firing and contract afterwards, high strength properties to form a reusable cartridge, etc. Currently, cartridge casings are formed from a wide variety of metal or metal alloys including steel and steel alloys, copper and copper alloys, and aluminum and aluminum alloys. One material which has traditionally been chosen for ammunition cartridge cases has been copper alloy C260. This is evidenced by its trade name—cartridge brass.

Copper alloy C260 is used in the manufacture of 270, 30-30, and 38 special cartridge casings. Typically, these cartridge casings have strength values and grain structure which vary along the length of the cartridge casing. For example, tensile strength varies from the soft to the extra spring temper, i.e. 55–102 ksi, from the mouth to the head end of the cartridge casing. Metallographic examinations have revealed a heavily cold worked coarse grain structure at the head end of the casing and a recrystallized fine grained microstructure at the mouth end.

In order to form members having a thin-walled structure and high strength characteristics suitable for use as cartridge casings, a wide spectrum of processes have been used. Frequently, these processes involve passing a blank of metal or metal alloy through a complex series of forming operations such as cupping, sequential drawing, annealing, clipping, neck sinking, piercing, etc. For example, in forming a 30-30 brass cartridge casing, there are over 20 operations including multiple drawing and annealing steps. In forming a 38 special brass cartridge casing, there are over 15 operations including several drawing and annealing steps.

One known prior art process for forming a cartridge casing from a copper-zinc alloy comprises casting a bar of the alloy of sufficient diameter that a fine grained cast structure results, cutting the bar into work pieces, and then, without any preliminary plastic deformation which alters the structure of the alloy, subjecting the work pieces to a series of drawing operations alternating with annealing treatments. This process is illustrated by U.S. Pat. No. 2,190,536 to Staiger.

A known prior art process for forming a high-strength cartridge casing from a heat treatable aluminum alloy comprises backwardly extruding a solid cylindrical blank into a cup-shaped member followed by drawing to thin and elongate the walls thereof. A blank of the aluminum alloy is backwardly extruded through an extrusion die to form the cup-shaped member. A partial annealing step is performed to remove cold work stresses resulting from the extrusion. The cup-shaped member is then passed to a draw punch assembly to form an elongated cup-like member having relatively thin cylindrical walls. After drawing, the member is preferably solution heat treated to obtain the optimum metallurgical and mechanical properties. After heat treatment, a combined shaping operation may be carried out to head, taper, neck and forge a primer cavity in the member. Since the strength resulting from the earlier cold working has been removed or neutralized by the solution heat treatment, the strength of the base portion is preferably increased by a forging operation which imparts to the base at least about 15% cold work. After forging, the member is precipitation heat treated to increase the hardness and strength thereof. This process is exemplified by U.S. Pat. No. 3,498,221 to Hilton et al.

Another process for forming a cartridge casing from either low carbon steel or brass is exemplified by U.S. Pat. No. 2,698,268 to Lyon. This process comprises placing a blank of metal onto a coining die to provide a disc having a central thickened portion and a portion which tapers from the center to the periphery of the disc. After coining, the disc is suitably annealed. The disc is then subjected to an initial cupping and drawing operation to form a casing. Following the cupping and drawing operation, the casing is subjected to additional drawing operations. A bulging operation is then performed to cold work a portion of casing adjacent the base. Subsequent to this bulging operation, the drawn cylindrical casing is subjected to an additional drawing operation. Thereafter, the base is shaped, a hole is punched in the base, and the lower part of the casing is subjected to a heat annealing process.

Yet another process for forming a shell comprises casting a steel shell, reheating the shell for the purpose of giving it uniformity of hardness, subjecting the shell to a longitudinal pressure for the purpose of eliminating porous places and for making the grain in the thinner places more dense than in the thicker areas, carburizing at least a portion of the shell, quenching the shell to harden it, and final machining to make the shell of uniform thickness. U.S. Pat. No. 1,303,727 to Rice illustrates this process. It should be noted that this process is intended to form a shell which fractures upon an explosion taking place.

As can be seen from the above discussion, the prior art processes are often very labor and equipment intensive and are, therefore, very costly. To reduce costs, it is desirable to simplify production processes by reducing the number of steps involved.

Besides the economic considerations, one must consider the other problems associated with these prior art techniques. For example, processes which utilize dies frequently encounter such problems as die erosion and adverse effects on dimensional tolerances caused by temperature retention within the dies during processing. Other problems may include the development of soft spots as a result of progressive drawing and annealing operations.

In looking at newer alloys to replace traditional materials, it has been discovered that thixotropic or slurry cast materials have several beneficial qualities. These qualities include improved die life and reduced thermal shock effects during processing.

The metal composition of a slurry cast material comprises primary solid discrete particles and a surrounding matrix. The surrounding matrix is solid when the metal composition is fully solidified and is liquid when the metal composition is a partially solid and partially liquid slurry. The primary solid particles comprise degenerate dendrites or nodules which are generally spheroidal in shape. Techniques for forming slurry cast materials and for casting and forging them are discussed in U.S. Pat. Nos. 3,902,544, 3,948,650 and 3,954,455 all to Flemings et al., 3,936,298 and 3,951,651 both to Mehrabian et al., and 4,106,956 to Bercovici, U.K. patent application Ser. No. 2,042,385A to Winter et al. published Sept. 24, 1980 and the articles "Rheocasting" by Flemings et al., *AFS International Cast Metals Journal,* September, 1976, pp. 11–22 and "Die Casting Partially Solidified High Copper Content Alloys" by Fascetta et al., *AFS Cast Metals Research Journal,* December, 1973, pp. 167–171.

While slurry cast materials having the aforementioned benefits are known in the art, there still remains the problem of identifying a slurry cast metal or metal alloy that exhibits the required physical properties and lends itself to more economical processing. A metal or metal alloy selected for forming a member which may eventually be processed into a cartridge casing should have the high strength properties needed to fabricate a thin-walled, reusable cartridge casing. The selected metal or metal alloy should also have good formability and fracture toughness properties. Good formability is desirable since cartridge casings frequently expand during firing and contract thereafter. Fracture toughness should be sufficient to withstand the shock associated with firing.

It has been unexpectedly found that by selecting an age hardenable, slurry cast copper base alloy and thixoforging it, a member having utility as a cartridge casing can be formed with at least as good strength properties as those formed by conventional processes. Furthermore, it has been found that the member can be formed into a cartridge casing using a process having a reduced number of processing steps. Therefore, the present invention comprises a process and apparatus for forming a thin-walled, elongated member having high strength and good ductility and fracture toughness properties from an age hardenable, slurry cast copper base alloy.

In accordance with the instant invention, a thin-walled, elongated member is formed by providing an age hardenable, slurry cast copper base alloy, forming a semi-solid slurry from the age hardenable, slurry cast copper base alloy, thixoforging the age hardenable copper base alloy slurry to form the thin-walled, elongated member, and age hardening the thixoforged member. In a preferred embodiment, the copper base alloy comprises an alloy consisting essentially of from about 3% to about 20% nickel, from about 5% to about 10% aluminum and the remainder copper.

By thixoforging a member from a semi-solid slurry of an age hardenable, slurry cast copper base alloy and thereafter age hardening the member, the member can be provided with high strength properties, a thin-walled elongated structure, an internal cavity having any desired configuration, etc. without having to undergo the numerous drawing and intermediate annealing operations of the prior art processes. Therefore, the process and apparatus of the instant invention reduces the number of steps needed to produce a high strength cartridge casing and reduces the costs associated with prior art processes.

Accordingly, it is an object of this invention to provide a process and apparatus for forming a thin-walled, high strength, elongated member.

It is a further object of this invention to provide a process and apparatus as above for forming a member having particular utility as a cartridge casing.

It is a further object of this invention to provide a process and apparatus as above which is more efficient and economic and which reduces the number of operations needed to produce a cartridge casing.

These and other objects will become more apparent from the following description and drawings.

Figure 1:
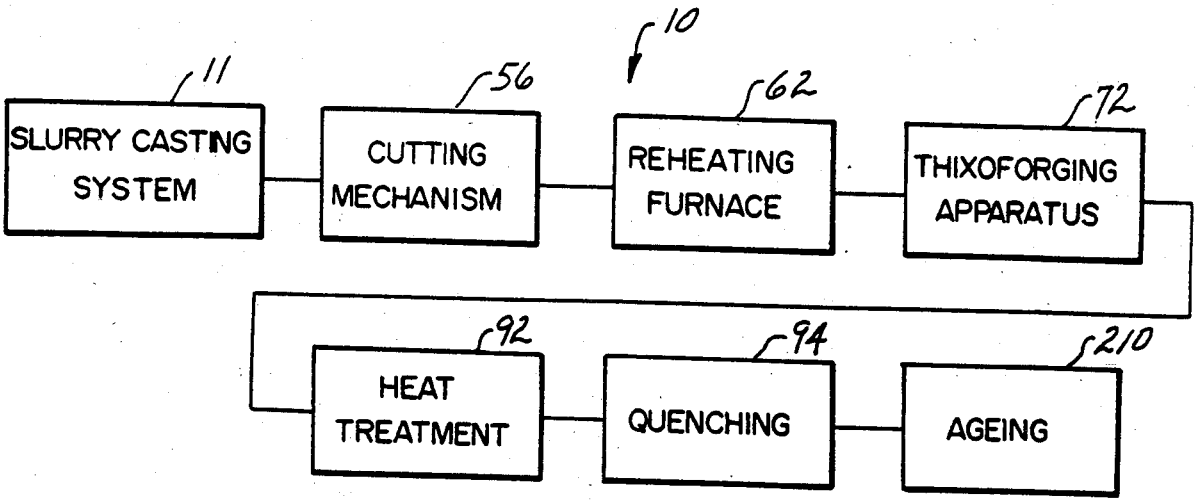
FIG. 1 is a block diagram of a first embodiment of an apparatus used for forming a cartridge casing.

In the background of this application, there has been briefly discussed prior art techniques for forming semi-solid thixotropic metal slurries for use in slurry casting, thixoforging, thixocasting, etc. Slurry casting as the term is used herein refers to the formation of a semi-solid thixotropic metal slurry directly into a desired structure such as a billet for later processing or a die casting formed from the slurry. Thixocasting or thixoforging, respectively, as the terms are used herein refer to processing which begins with a slurry cast material which is reheated for further processing such as die casting or forging.

The instant invention is directed to a process and apparatus for forming a thin-walled, elongated member having particular utility as a cartridge casing. The process described herein makes use of a semi-solid slurry of an age hardenable copper base alloy. The advantages of slurry cast materials have been amply described in the prior art. Those advantages include improved casting soundness as compared to conventional die casting. This results because the metal is semi-solid as it enters a mold with about 5% to about 40%, most preferably about 10% to about 30% eutectic, which is believed to result from non-equilibrium solidification and, hence, less shrinkage porosity occurs. Machine component life is also improved due to reduced erosion of dies and molds and reduced thermal shock associated with slurry casting.

The metal composition of a semi-solid slurry comprises primary solid discrete particles and a surrounding matrix. The surrounding matrix is solid when the metal composition is fully solidified and is liquid when the metal composition is a partially solid and partially liquid slurry. The primary solid particles comprise degenerate dendrites or nodules which are generally spheroidal in shape. The primary solid particles are made up of a single phase or a plurality of phases having an average composition different from the average composition of the surrounding matrix in the fully-solidified alloy. The matrix itself can comprise one or more phases upon further solidification.

Conventionally solidified alloys have branched dendrites which develop interconnected networks as the temperature is reduced and the weight fraction of solid increases. In contrast, semi-solid metal slurries consist of discrete primary degenerate dendrite particles separated from each other by a liquid metal matrix. The primary solid particles are degenerate dendrites in that they are characterized by smoother surfaces and a less branched structure than normal dendrites, approaching a spheroidal configuration. The surrounding solid matrix is formed during solidification of the liquid matrix subsequent to the formation of the primary solids and contains one or more phases of the type which would be obtained during solidification of the liquid alloy in a more conventional process. The surrounding matrix comprises dendrites, single or multi-phased compounds, solid solution, or mixtures of dendrites, and/or compounds, and/or solid solutions.

Referring now to FIGS. 1–6 and 8, an apparatus 10 for forming a thin-walled, elongated member is shown. Apparatus 10 has a system 11 for slurry casting a continuous member 46. Slurry casting system 11 may comprise a container 14 in which an age hardenable metal alloy 12 is maintained, preferably in molten form. A plurality of induction heating coils 16 surround the container 14. The induction heating coils 16 may be used to heat metal alloy 12 to the liquid state or to maintain metal alloy 12 at a temperature above the liquidus temperature.

Container 14 has at least one opening 18 through which the molten metal alloy 12 passes into a stirring zone 20. The size of the opening 18 may be regulated by a set of baffles 22. A suitable stirrer 24, such as an auger, is provided within the stirring zone 20. The stirrer 24 may be mounted to a rotatable shaft 26 which is powered by any suitable means not shown.

Stirring zone 20 is provided with an induction heating coil 28 and a cooling jacket 30 for controlling the amount of heat and the temperature of the metal alloy within the stirring zone. Cooling jacket 30 has a fluid inlet 32 and a fluid outlet 34. Any suitable coolant, preferably water, may be utilized.

The distance between the inner surface 36 of the stirring zone and the outer surface 38 of the stirrer 24 should be maintained so that high shear forces can be applied to the semi-solid slurry formed in the stirring zone. The shear forces should be sufficient to prevent the formation of interconnected dendritic networks while at the same time allowing passage of the semi-solid slurry through the stirring zone. Since the induced rate of shear in the semi-solid slurry at a given rotational speed of stirrer 24 is a function of both the radius of the stirring zone and the radius of the stirrer, the clearance distance will vary with the size of the stirrer and the stirring zone. To induce the necessary shear rates, increased clearances can be employed with larger stirrers and stirring zones.

An opening 40 is provided in the bottom surface of the stirring zone 20. The size of the opening 40 may be controlled by raising or lowering shaft 26 so that the bottom end of stirrer 24 fits into all or a portion of the opening 40. The semi-solid slurry 42 exiting the stirring zone through opening 40 may be directed to a casting device 44 for continuously casting a solid member or casting 46.

Casting device 44 may comprise any conventional casting arrangement known in the art. In a preferred embodiment, casting device 44 comprises a mold 48 surrounded by a cooling jacket 50. Mold 48 preferably has a cylindrical shape, although it may have any desired configuration. Mold 48 may be made of any suitable material such as copper and copper alloys, aluminum and aluminum alloys, austenitic stainless steel and its alloys, etc. Cooling jacket 50 has a fluid inlet 52 and a fluid outlet 54. Any suitable coolant known in the art may be used. In a preferred embodiment, the coolant is water.

Solidification is effected by extracting heat from the semi-solid slurry through the inner and outer walls 51 and 53, respectively, of mold 48 and by spraying coolant against the solidifying casting 46. Any conventional withdrawal mechanism not shown may be used to withdraw casting 46 from mold 48 at any desired rate.

Figure 2:
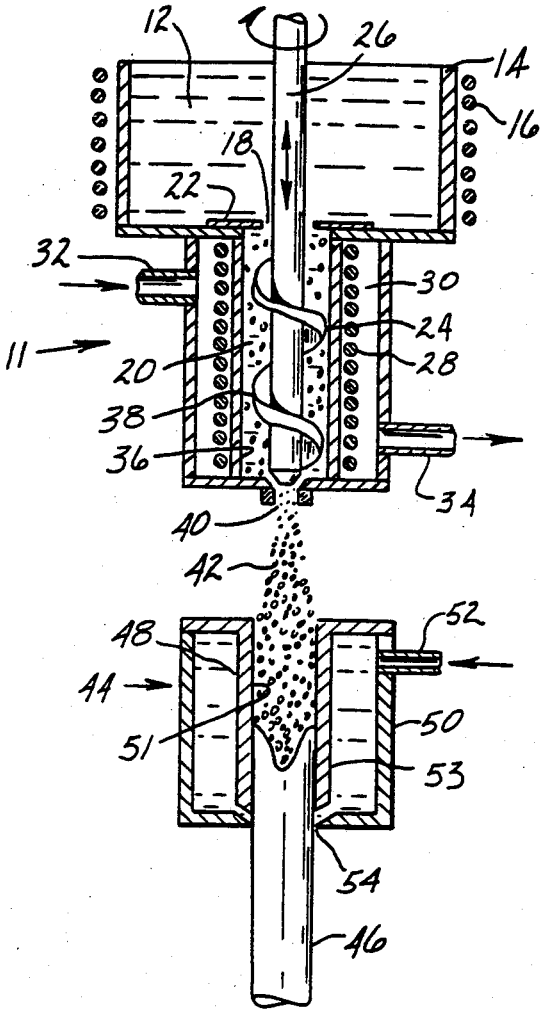
FIG. 2 is a schematic view in partial cross section of an apparatus for slurry casting a continuous member which may be used in the apparatus of FIG. 1.
Figure 3:
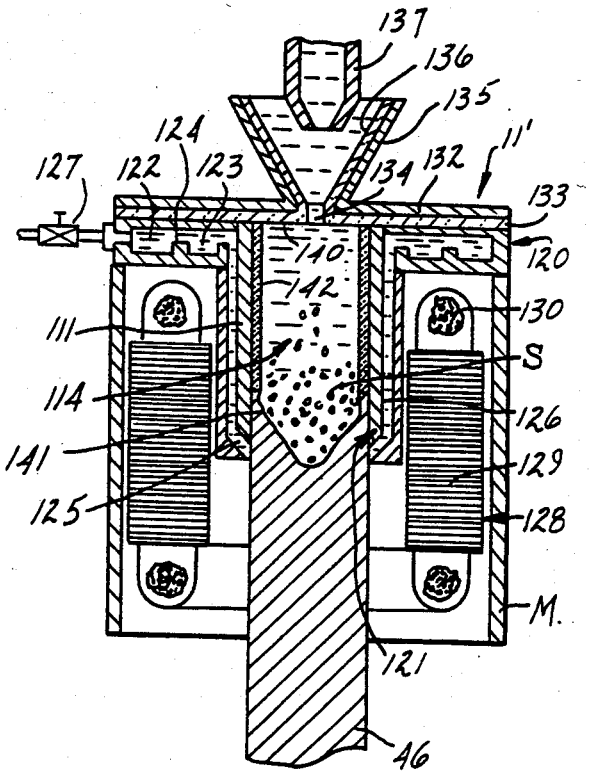
FIG. 3 is a schematic view in partial cross section of another apparatus for slurry casting a continuous member which may be used in the apparatus of FIG. 1.
Figure 4:
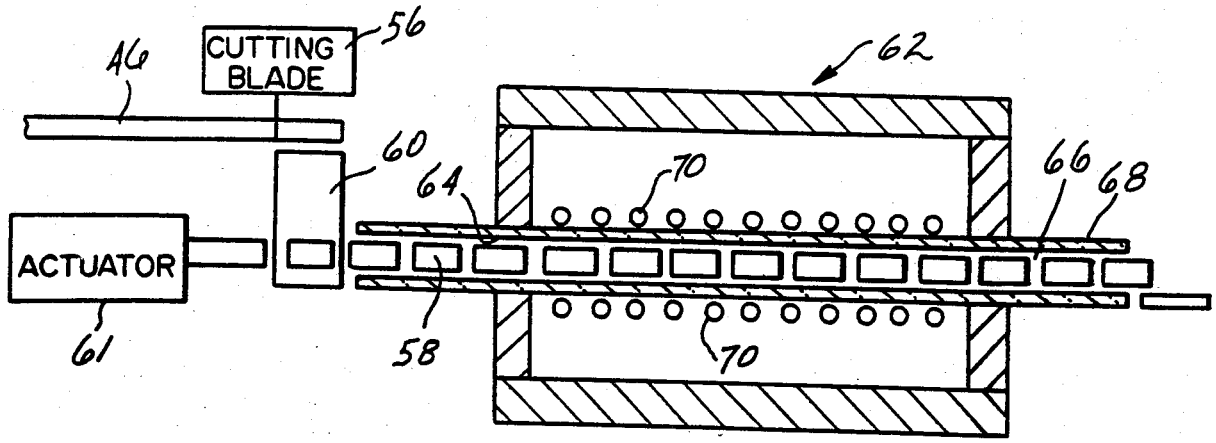
FIG. 4 is a schematic view in partial cross section of an apparatus for cutting the continuous member produced by the apparatus of either FIG. 2 or FIG. 3 into blanks and for reheating the blanks.

In lieu of the slurry casting system of FIG. 2, the preferred slurry casting system 11' of FIG. 3 may be used. Slurry casting system 11' has a mold 111 adapted for continuously or semi-continuously slurry casting thixotropic metal slurries. Mold 111 may be formed of any desired non-magnetic material such as stainless steel, copper, copper alloy or the like. The mold 111 may have any desired cross-sectional shape. In a preferred embodiment, mold 111 has a circular cross-sectional shape.

A cooling manifold 120 is arranged circumferentially around the mold wall 121. The particular manifold shown includes a first input chamber 122, a second chamber 123 connected to the first input chamber by a narrow slot 124. A discharge slot 125 is defined by a gap between the manifold 120 and the mold 111. A uniform curtain of water is provided about the outer surface 126 of the mold 111. A suitable valving arrangement 127 is provided to control the flow rate of the water or other coolant discharged in order to control the rate at which the semi-solid slurry S solidifies. While valve 127 is shown as being manually operated, if desired it may be an electrically operated valve.

The molten metal which is poured into the mold 111 is cooled under controlled conditions by means of the water contacting the outer surface 126 of the mold 111 from the encompassing manifold 120. By controlling the rate of water flow against the mold surface 126, the rate of heat extraction from the molten metal within the mold 111 is in part controlled.

In order to provide a means for stirring the molten metal within the mold 111 to form the desired semi-solid slurry, a two pole multi-phase induction motor stator 128 is arranged surrounding the mold 111. The stator 128 is comprised of iron laminations 129 about which the desired windings 130 are arranged in a conventional manner to provide a multi-phase induction motor stator. The motor stator 128 is mounted within a motor housing M. The manifold 120 and the motor stator 128 are arranged concentrically about the axis 118 of the mold 111 and casting 46 formed within it.

It is preferred in accordance with this invention to utilize a two pole, three-phase induction motor stator 128. One advantage of the two pole motor stator 128 is that there is a non-zero field across the entire cross section of the mold 111. It is, therefore, possible with this system to solidify a casting having the desired slurry cast structure over its full cross section. The two pole induction motor stator 128 also provides a higher frequency of rotation or rate of stirring of the slurry S for a given current frequency.

A partially enclosing cover 132 is utilized to prevent spill out of the molten metal and slurry S due to the stirring action imparted by the magnetic field of the motor stator 128. The cover 132 comprises a metal plate arranged above the manifold 120 and separated therefrom by a suitable ceramic liner 133. The cover 132 includes an opening 134 through which the molten metal flows into the mold cavity 114. Communicating with the opening 134 in the cover is a funnel 135 for directing the molten metal into the opening 134. A ceramic liner 136 is used to protect the metal funnel 135 and the opening 134. As the slurry S rotates within the mold cavity, centrifugal forces cause the metal to try to advance up the mold wall 121. The cover 132 with its ceramic lining 133 prevents the metal slurry S from advancing or spilling out of the mold cavity. The funnel portion 135 of the cover 132 also serves as a reservoir of molten metal to keep the mold 111 filled in order to avoid the formation of a U-shaped cavity in the end of the casting due to centrifugal forces.

Situated directly above the funnel 135 is a downspout 137 through which the molten metal flows from a suitable furnace not shown. A valve member not shown associated in a coaxial arrangement with the downspout 137 may be used in accordance with conventional practice to regulate the flow of molten metal into the mold 111.

The furnace not shown may be of any conventional design; it is not essential that the furnace be located directly above the mold 111. In accordance with conventional direct chill casting processing, the furnace may be located laterally displaced therefrom and be connected to the mold 111 by a series of troughs or launders not shown.

It is preferred that the stirring force field generated by the stator 128 extend over the full solidification zone of molten metal and semi-solid metal slurry S. Otherwise, the structure of the casting will comprise regions within the field of the stator 128 having a slurry cast structure and regions outside the stator field tending to have a non-slurry cast structure. In the embodiment of FIG. 3, the solidification zone preferably comprises the sump of molten metal and slurry S within the mold 111 which extends from the top surface 140 to the solidification front 141 which divides the solidified casting 46 from the slurry S. The solidification zone extends at least from the region of the initial onset of solidification and slurry formation in the mold cavity 114 to the solidification front 141.

Under normal solidification conditions, the periphery of the casting 46 will exhibit a columnar dendritic grain structure. Such a structure is undesirable and detracts from the overall advantages of the slurry cast structure which occupies most of the ingot cross section. In order to eliminate or substantially reduce the thickness of this outer dendritic layer, the thermal conductivity of the upper region of the mold 111 is reduced by means of a partial mold liner 142 formed from an insulator such as a ceramic. The ceramic mold liner 142 extends from the ceramic liner 133 of the mold cover 132 down into the mold cavity 114 for a distance sufficient so that the magnetic stirring force field of the two pole motor stator 128 is intercepted at least in part by the partial ceramic mold liner 142. The ceramic mold liner 142 is a shell which conforms to the internal shape of the mold 111 and is held to the mold wall 121. The mold 111 comprises a duplex structure including a low heat conductivity upper portion defined by the ceramic liner 142 and a high heat conductivity portion defined by the exposed portion of the mold wall 121.

The liner 142 postpones solidification until the molten metal is in the region of the strong magnetic stirring force. The low heat extraction rate associated with the liner 142 generally prevents solidification in that portion of the mold 111. Generally, solidification does not occur except towards the downstream end of the liner 142 or just thereafter. The shearing process resulting from the applied rotating magnetic field will further override the tendency to form a solid shell in the region of the liner 142. This region 142 or zone of low thermal conductivity thereby helps the resultant slurry casting 46 to have a degenerate dendritic structure throughout its cross section even up to its outer surface.

Below the region of controlled thermal conductivity defined by the liner 142, the normal type of water cooled metal casting mold wall 121 is present. The high heat transfer rates associated with this portion of the mold 111 promote shell formation. However, because of the zone 142 of low heat extraction rate, even the peripheral shell of the casting 46 should consist of degenerate dendrites in a surrounding matrix.

It is preferred in order to form the desired slurry cast structure at the surface of the casting to effectively shear any initial solidified growth from the mold liner 142. This can be accomplished by insuring that the field associated with the motor stator 128 extends over at least that portion of the liner 142 at which solidification is first initiated.

The dendrites which initially form normal to the periphery of the casting mold 111 are readily sheared off due to the metal flow resulting from the rotating magnetic field of the induction motor stator 128. The dendrites which are sheared off continue to be stirred to form degenerate dendrites until they are trapped by the solidifying interface 141. Degenerate dendrites can also form directly within the slurry because the rotating stirring action of the melt does not permit preferential growth of dendrites. To insure this, the stator 128 length should preferably extend over the full length of the solidification zone. In particular, the stirring force field associated with the stator 128 should preferably extend over the full length and cross section of the solidification zone with a sufficient magnitude to generate the desired shear rates.

To form a casting 46 utilizing the system 11' of FIG. 3, molten metal is poured into the mold cavity 114 while the motor stator 128 is energized by a suitable three-phase AC current of a desired magnitude and frequency. After the molten metal is poured into the mold cavity, it is stirred continuously by the rotating magnetic field produced by the motor stator 128. Solidification begins from the mold wall 121. The highest shear rates are generated at the stationary mold wall 121 or at the advancing solidification front 141. By properly controlling the rate of solidification by any desired means as are known in the prior art, the desired semi-solid slurry S is formed in the mold cavity 114. As a solidifying shell is formed on the casting 46, a standard direct chill casting type bottom block not shown is withdrawn downwardly at a desired casting rate.

Casting 46 preferably comprises a continuous member having any desired shape, i.e. a bar, a rod, a wire, etc. When the casting 46 is to be used in a process for making cartridge casings, casting 46 preferably has a circular cross section.

Casting 46 is passed by any suitable means not shown to a cutting device 56. Cutting device 56 may comprise any conventional apparatus for cutting a continuous member such as a flying shear blade for hot or cold shearing, a sawing blade, etc. Casting 46 is preferably cut into any desired number of blanks or slugs 58 having a desired thickness. Slugs or blanks 58 are preferably cut to provide a sufficient volume of metal to fill the die cavities of a forging apparatus plus an allowance for flash and sometimes for a projection for holding the forging.

In a preferred embodiment of the instant invention, metal alloy 12 comprises an age hardenable copper base alloy. Although the alloy composition can be varied to satisfy the requirements of strength and ductility, in a preferred embodiment, an alloy consisting of about 3% to about 20%, more preferably from about 5% to 15% by weight nickel; from about 5% to about 10%, more preferably from about 6% to about 9% by weight aluminum; and the remainder being copper is used. The incorporation of the nickel and aluminum into the alloy is intended to provide an age hardenable system. Naturally, the alloy composition may also contain impurities common for alloys of this type and additional additives may be employed in the alloy, as desired, in order to emphasize particular characteristics or to obtain particularly desirable results.

In lieu of casting the metal alloy and cutting it into slugs 58, a source of the slurry cast metal alloy may comprise a pre-cut billet of a slurry cast metal alloy. Alternatively, the source of slurry cast metal alloy could comprise the semi-solid slurry created in either system 11 or system 11'.

The slugs 58 may be transferred by any suitable conveying mechanism 60, i.e. a conveyor belt, a chute, etc., to a heating source 62. Heating source 62 is used to reheat the slugs 58 to a temperature sufficient to reform the semi-solid slurry. The slugs should have sufficient integrity that there is no need to provide a container to hold the slurry; however, if desired, each slug may be placed in a suitable container in a conventional fashion during reheating. The reheating is preferably performed rapidly so as to minimize homogenization. In a preferred embodiment, heating source 62 comprises an induction coil furnace. The furnace 62 has an inlet 64 and an outlet 66. Any suitable actuator means 61, such as a hydraulically actuated ram, may be used to pass the slugs 58 into and through the furnace 62. Within the furnace 62, slugs 58 pass through a refractory insulator 68 surrounded by induction coil 70. Induction coil 70 preferably comprises water cooled copper tubing. Induction coil 70 is connected to a source of electrical power not shown so that electric current is carried by the tubing. In lieu of an induction furnace, any suitable furnace known in the art may be used.

The temperature to which the slugs 58 are heated should be achieved rapidly so that the slugs 58 retain as fine a structure as possible. It is preferable to forge a fine structure rather than a coarse structure because coarse structures have a higher viscosity. The temperature to which the slugs 58 are heated should be sufficient to put about 10% to about 30% of the metal alloy forming the slugs back into the liquid phase. This is done primarily to keep the solid phase of the metal alloy separate from the solute phase.

When the metal alloy comprises the aforementioned age hardenable copper base alloy, the slugs 58 are reheated to a temperature of at least about 800° C. Preferably, the temperature is within the range of about 1040° C. to about 1075° C., most preferably about 1050° C. to about 1060° C.

After reheating, the slugs 58 are transferred by any suitable means not shown to a thixoforging apparatus 72. Thixoforging apparatus 72 preferably comprises a closed die forging apparatus. The use of a closed die forging apparatus is preferred because it permits complex shapes and heavy reductions to be made with closer dimensional tolerances than are usually feasible with open die forging apparatuses. Closed die forging also allows control of grain flow direction and often improves mechanical properties in the longitudinal direction of the workpiece.

Thixoforging apparatus 72 has a lower die 74 located within an anvil cap 76 mounted to a frame 78. The metal alloy in the form of the reheated slug 58 is placed in the lower die 74. An upper die 79 is connected to a weighted ram 80. Ram 80 may be actuated by any conventional system, such as an air lift system, a hydraulic system, a board system, etc. Ram 80 is raised by the actuator not shown to a desired position and then dropped. The striking force imposed by the upper die 79 and the weighted ram 80 causes the metal alloy to deform.

Figure 5:
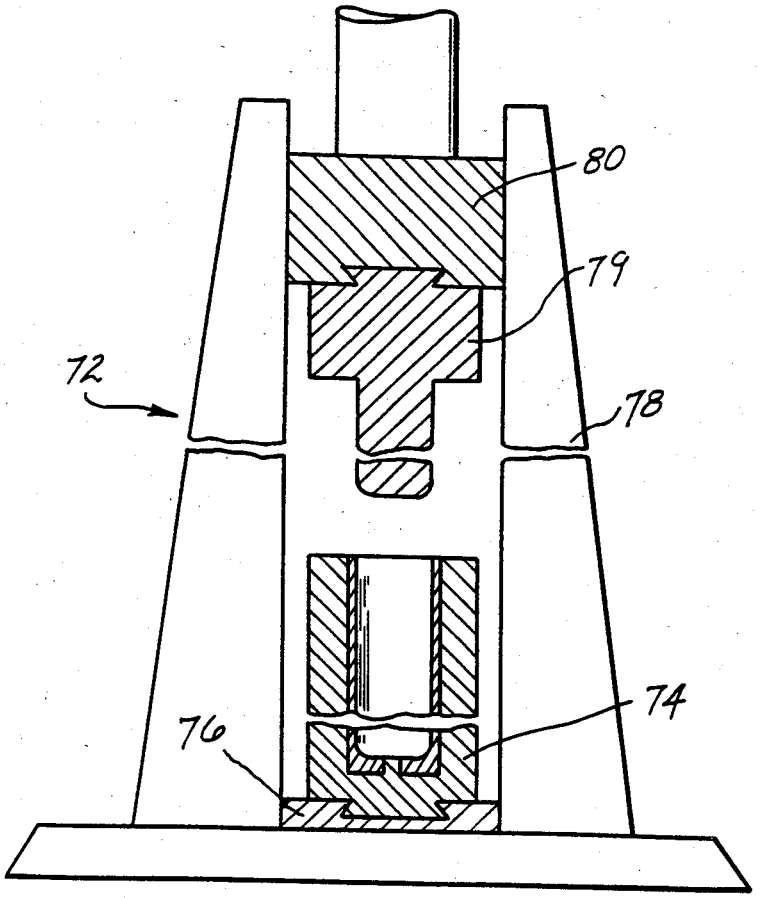
FIG. 5 is a schematic view in partial cross section of an apparatus for thixoforging the blanks into thin-walled, elongated members.
Figure 6:
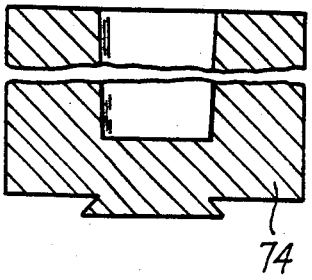
FIG. 6 is a schematic view in cross section of an alternative configuration of the lower die of the thixoforging apparatus of FIG. 4 for forming a member without a bottom hole.
Figure 8:
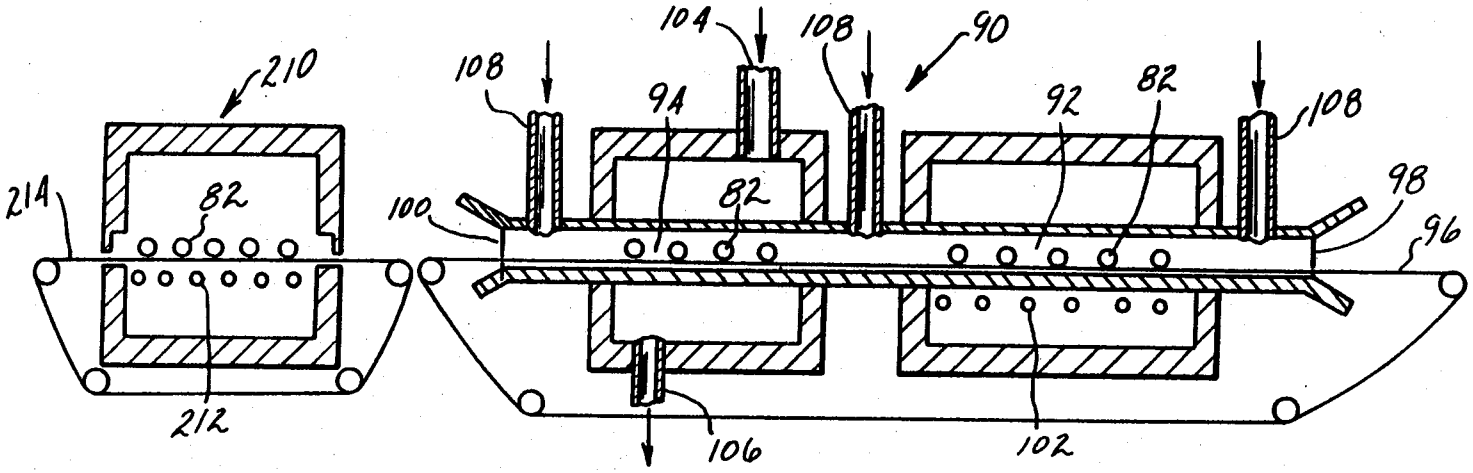
FIG. 8 is a schematic view in partial cross section of an apparatus for heat treating the members formed by the thixoforging apparatus of FIG. 5.
Figure 9:
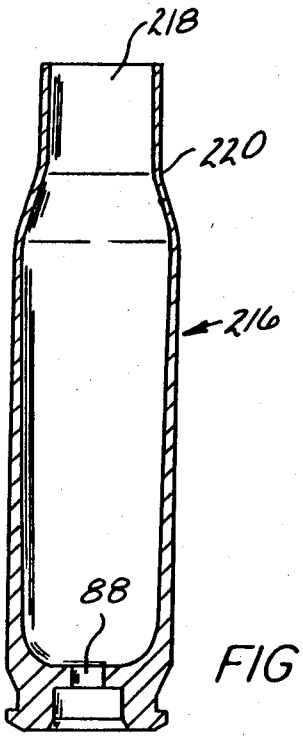
FIG. 9 is a cross section view of a cartridge casing formed in accordance with the process of the instant invention.
Figure 7:
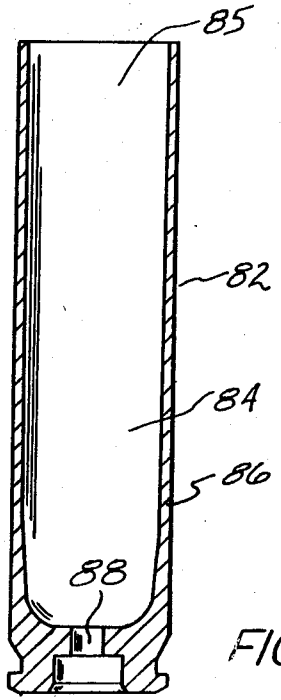
FIG. 7 is a cross section view of a cup-shaped member that can be formed by the thixoforging apparatus of FIG. 5.

The dies may be configured as shown in FIG. 5 to produce a member 82 having a thin-walled, elongated, cup-shaped configuration having an internal cavity 84 with sides 86 which, if desired, may be substantially parallel and top and bottom openings 85 and 88, respectively. If desired, the lower die 74 may be configured as shown in FIG. 6 to produce a member without a bottom hole. If member 82 is to be used as a cartridge casing, hole 88 may later be used to receive a primer into the cartridge casing. Dies 74 and 79 may be configured to produce a member having any desired shape.

It has been found to be desirable to thixoforge the age hardenable copper base alloy when the semi-solid slurry has about 10% to about 30% of the alloy in the liquid phase because this minimizes significant changes in the volume fraction liquid at the thixoforging temperature as a function of small variations in the thixoforging temperature, provides better dimensional tolerance, and provides improved die life. Preferably, the thixoforging temperature is the eutectic temperature of the alloy.

During the thixoforging operation, it is desirable to heat the dies by any suitable means not shown. Heating the dies substantially prevents any freezing before forging and helps minimize hot tearing. It is also desirable to lubricate the dies before each forging operation. Lubrication may be done in any conventional manner using any conventional lubricant known in the art.

After the thixoforging operation has been completed, member 82 is subjected to additional processing to enhance its mechanical properties, particularly its strength characteristics. In a preferred method of forming member 82 into its final product, member 82 is subjected to a treatment for precipitation hardening the metal alloy forming the member 82.

The thixoforged member 82 may be passed to a furnace 90 by any suitable means not shown. A plurality of thixoforged members 82 may be precipitation hardened as a batch or each thixoforged member 82 may be precipitation hardened individually. If the members 82 are to be batch treated, furnace 90 may be heated either electrically or by oil or gas and may contain any desired atmosphere. When non-explosive atmospheres are used, an electrically heated furnace permits the introduction of the atmosphere directly into the work chamber. If the furnace 90 is heated by gas or oil and employs a protective atmosphere, a muffle not shown may be provided to contain the atmosphere and protect the members 82 from the direct fire of the burners. If an explosive atmosphere is used, an operating muffle that prevents the infiltration of air is required. In a preferred embodiment of the apparatus 10, the members 82 are individually treated.

Furnace 90 has a heating chamber 92 of sufficient length to assure complete solution treating and a quenching chamber 94. The members 82 are preferably conveyed through the heating and quenching chambers at a desired rate by an endless belt 96. The furnace 90 has seals 98 and 100 to maintain a desired atmosphere within the chambers.

The heating chamber 92 has gas burners 102 for providing heat. In lieu of gas burners 102, any suitable source of heat may be used. If desired, heat chamber 92 may be divided into individual temperature controlled heating zones so that a high temperature may be developed in the entrance zone to facilitate heating members 82 to the desired temperature.

If desired, a molten neutral salt may be used for annealing, stress relieving, and solution heat treating the members 82. The composition of the salt mixture depends upon the temperature range required. Compositions may include mixtures of sodium chloride and potassium chloride, mixtures of barium chloride with chlorides of sodium and potassium, mixtures of calcium chloride, sodium chloride and barium chloride, mixtures of sodium chloride-carbonate, or any other suitable mixture.

Quenching chamber 94 may be either a long tunnel through which a cool protective atmosphere is circulated or a fluid quench zone supplied with a protective atmosphere. If a fluid quench zone is used, the fluid may comprise water, oil, air, etc. Chamber 94 is provided with at least one fluid inlet 104 and at least one fluid outlet 106. Both chambers 92 and 94 may be provided with any desired atmosphere through conduits 108.

Member 82 is maintained in the heating chamber 92 for a period of time and at a temperature sufficient to dissolve the alloying constituents, to equilibriate composition throughout the member 82, and to take at least one of the alloy constituents as a solute into solid solution. After the heat treatment, member 82 is passed through quenching chamber 94 to cool the member 82 at a rate sufficiently rapid to retain the solute in a supersaturated solid solution and to prevent early precipitation.

When the member 82 is formed from said aforementioned age hardenable copper base alloy, member 82 is heated to a temperature of at least 800° C. for a time period of about 5 minutes to about 4 hours. In a preferred embodiment, member 82 is heated to a temperature in the range of about 800° C. to about 1000° C. for about 5 minutes to about 30 minutes, preferably about 15 minutes.

After quenching, the member 82 is subjected to an aging treatment. The member 82 is passed to a furnace 210 for heating the member 82 to a temperature preferably below the solutionizing temperature for a period of time sufficient to allow the solute to precipitate. Furnace 210 may comprise an induction heat furnace, a forced-convection furnace, or any other suitable type of furnace. Furnace 210 has heating source 212 and means 214 for conveying the members 82 through the furnace. Conveyor means 214 may comprise any suitable means such as an endless belt, rollers, etc. Furnace 210 may have any desired atmosphere as long as it is compatible with the metal alloy forming the member 82.

When the member 82 is formed from said aforementioned copper base alloy, member 82 is preferably heated in furnace 210 to a temperature in the range of about 350° C. to about 700° C. for a time period of at least about 30 minutes to about 10 hours. In a preferred embodiment, the aging treatment is conducted at a temperature of about 400° C. to about 600° C., preferably at about 500° C., for about 1 to about 3 hours.

When subjected to the above discussed precipitation hardening treatment, the member 82 formed of said precipitation hardenable copper base alloy has a tensile strength of at least about 80 ksi and a yield strength of at least about 65 ksi. Preferably, the member 82 in its precipitation hardened and thixoforged condition has a tensile strength in the range of about 80 ksi to about 120 ksi and a yield strength of approximately 65 ksi to about 110 ksi.

If it is desired to provide the member 82 with different mechanical properties, i.e. strength, at its opposite ends, one end may be kept in an annealed condition by keeping it cold while the other end is age hardened in an induction furnace.

In lieu of the aforementioned precipitation hardening treatment, member 82 may be subjected to an aging treatment without the solution heat treatment and quenching steps of the precipitation hardening treatment. Thixoforged members 82 may each be passed to an aging furnace, such as furnace 210 of FIG. 8, by any suitable means not shown immediately after the thixoforging operation has been completed. As before, furnace 210 may comprise an induction heating furnace, a forced convection furnace, or any other suitable type of furnace. The member 82 is heated within the furnace 210 to a temperature below the solutionizing temperature for a period of time sufficient to increase the hardness of the metal alloy forming the member 82. When the metal alloy forming the member 82 to be subjected to only an aging treatment comprises said aforementioned copper-nickel-aluminum alloy, the alloy composition preferably consists essentially of about 8% to about 15%, most preferably about 10%, by weight nickel; from about 6% to about 9%, most preferably about 7½%, by weight aluminum; and the remainder being copper. The member 82 is preferably heated to a temperature of about 350° C. to about 700° C., more preferably about 400° C. to about 600° C., for a time period of about 30 minutes to 10 hours, more preferably about 1 hour to about 4 hours. After being subjected to such an aging treatment, member 82 should have strength properties similar to those obtained by the precipitation hardening treatment. Tensile strengths in excess of 100 ksi may be obtained.

After the member 82 has been age hardened, it may undergo additional processing steps to produce cartridge casing 216. The additional processing steps may include final sizing, swaging, annealing of the mouth 218, sinking of the neck 220, etc. If sizing is required in order to provide mouth 218 with its proper dimensions, sizing is preferably performed using a conventional closed die arrangement not shown. The additional processing steps may be performed by any conventional means in any conventional manner.

If desired, some of the cartridge processing steps may be performed prior to any age hardening treatments. For example, neck 220 may be sunk immediately after the member 82 has been thixoforged.

Other processing steps may be interposed between the thixoforging operation and the age hardening treatment if needed. For example, one or more drawing operations may be performed to thin out the walls of the member 82. If desired, member 82 may be work hardened prior to the age hardening treatment.

While the above invention has been described in terms of a particular alloy system, any suitable age hardenable metal alloy including other copper based alloys, may be utilized as long as it contains an eutectic which will give about 10% to about 30% liquid at the thixoforging temperature.

The particular parameters employed can vary from metal system to metal system. The appropriate parameters for alloy systems other than the copper alloy of the preferred embodiment can be determined by routine experimentation in accordance with the principles of this invention.

The patents, patent applications, and articles set forth in this specification are intended to be incorporated by reference herein.

It is apparent that there has been provided in accordance with this invention a process and apparatus for making a thixoforged copper alloy cartridge casing which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. A copper base alloy having a structure comprising a plurality of discrete particles in a surrounding metal matrix, said particles and said matrix being comprised such that when said alloy is heated to a desired temperature said alloy forms a semi-solid slurry wherein said matrix is in a molten condition comprising from about 5 to about 40% liquid and said particles are within said liquid matrix, said alloy consisting essentially of about 3% to about 20% nickel, about 5% to about 10% aluminum, and the balance essentially copper.

2. The copper alloy of claim 1 wherein:
said alloy consists essentially of about 5% to about 15% nickel, from about 6% to about 9% aluminum, and the balance essentially copper.

3. The copper alloy of claim 1 wherein:
said alloy consists essentially of about 8% to about 15% nickel, from about 6% to 9% aluminum, and the balance essentially copper.

4. The copper alloy of claim 1 wherein:
said copper alloy is precipitation hardenable.

5. The copper alloy of claim 1 further comprising:
said copper allow being in a precipitation hardened condition.

6. The copper alloy of claim 1 further comprising:
said copper alloy being forged from said semi-solid slurry condition.

7. The copper alloy of claim 1 further comprising:
said copper alloy being forged from said semi-solid slurry condition and precipitation hardened.

8. The copper alloy of claim 1 further comprising:
said discrete particles comprising degenerate dendrites having a generally spheroidal shape.

9. A copper alloy as in claim 1 wherein said matrix at said desired temperature comprises from about 10 to about 30% liquid.

* * * * *